US007101404B2

(12) United States Patent
Korfer

(10) Patent No.: US 7,101,404 B2
(45) Date of Patent: Sep. 5, 2006

(54) PAPER MACHINE CLOTHING, ESPECIALLY PRESS FELT, AS WELL AS A METHOD FOR MANUFACTURING THE PAPER MACHINE CLOTHING

(75) Inventor: Stefan Korfer, Monchengladbach (DE)

(73) Assignee: Heimbach GmbH & Co., Duren (DE)

( * ) Notice: Subject to any disclaimer, the term of this patent is extended or adjusted under 35 U.S.C. 154(b) by 178 days.

(21) Appl. No.: 10/354,968

(22) Filed: Jan. 31, 2003

(65) Prior Publication Data

US 2003/0232557 A1 Dec. 18, 2003

(30) Foreign Application Priority Data

Feb. 1, 2002 (DE) ..... 102 04 356

(51) Int. Cl.
*D06Q 1/02* (2006.01)

(52) U.S. Cl. ..... 8/114.6; 156/155; 112/403; 162/358.2; 162/900; 442/366; 442/381

(58) Field of Classification Search ..... 156/155; 8/114.6; 112/403; 162/358.2, 900; 442/366, 442/381

See application file for complete search history.

(56) References Cited

U.S. PATENT DOCUMENTS

| | | | | |
|---|---|---|---|---|
| 3,158,984 A | * | 12/1964 | Butler | 57/210 |
| 3,458,911 A | | 8/1969 | Koester | |
| 4,482,601 A | | 11/1984 | Hartigan, Jr. | |
| 4,501,792 A | * | 2/1985 | Holmes et al. | 442/415 |
| 4,781,967 A | * | 11/1988 | Legge et al. | 428/109 |
| 5,204,171 A | | 4/1993 | Eschmann | |
| 5,361,808 A | | 11/1994 | Bowen, Jr | |
| 5,449,548 A | | 9/1995 | Bowen, Jr. | |
| 5,591,525 A | | 1/1997 | Keller | |
| 5,672,021 A | * | 9/1997 | Abber et al. | 401/189 |
| 6,155,308 A | * | 12/2000 | Kuji | 139/410 |
| 6,223,781 B1 | * | 5/2001 | Yamada et al. | 139/383 AA |
| 6,234,213 B1 | | 5/2001 | Kobayashi et al. | |
| 6,284,678 B1 | * | 9/2001 | Kobayashi et al. | 442/207 |
| 6,425,985 B1 | * | 7/2002 | Hagfors et al. | 162/358.2 |
| 6,442,318 B1 | * | 8/2002 | Goldman | 385/114 |

FOREIGN PATENT DOCUMENTS

| | | | |
|---|---|---|---|
| DE | 1245908 | | 8/1967 |
| DE | 2120967 | * | 11/1971 |
| DE | 40 31 608 A1 | | 4/1991 |
| DE | 40 40 861 C2 | | 4/1994 |
| DE | 195 45 386 A1 | | 6/1996 |
| DE | 199 00 989 A1 | | 1/2000 |
| EP | 0038276 A1 | | 4/1981 |
| EP | 0 413 869 B1 | | 8/1989 |
| EP | 0 567 206 A1 | | 10/1993 |

(Continued)

*Primary Examiner*—Andrew T. Piziali
(74) *Attorney, Agent, or Firm*—Berenato, White & Stavish, LLC

(57) ABSTRACT

Paper machine clothing, especially a press felt (1), has a support (2) which has at least one layer of a thread lap (3, 4, 5, 13). The lap threads (6, 7, 8, 9, 10, 14, 17, 21, 25, 26, 27, 28, 33, 38, 43, 44, 45) run parallel to one another. Spacing threads are present which run between two lap threads (6, 7, 8, 9, 10, 14, 17, 21, 25, 26, 27, 28, 33, 38, 43, 44, 45) and are soluble in a solvent in which the remaining part of the paper machine clothing (1) is not soluble.

35 Claims, 4 Drawing Sheets

FOREIGN PATENT DOCUMENTS

| | | |
|---|---|---|
| EP | 0 394 293 B1 | 5/1994 |
| EP | 0 466 990 B1 | 2/1995 |
| EP | 1 067 239 A2 | 1/2001 |
| GB | 1536231 | 12/1978 |
| WO | WO 98/07925 | 2/1998 |
| WO | PCT WO 99/64670 | 12/1999 |

* cited by examiner

PAPER MACHINE CLOTHING, ESPECIALLY PRESS FELT, AS WELL AS A METHOD FOR MANUFACTURING THE PAPER MACHINE CLOTHING

The invention concerns a paper machine clothing, especially a press felt, with a support which has at least one thread lap with lap threads running parallel to one another. The invention moreover relates to a method for manufacturing a paper machine clothing.

Paper machine clothes are bands of great length and width circulating in paper machines, which serve to form and guide the paper web through the paper machine. Their construction depends greatly upon in which part they are installed in the paper machine. Press felts in which a support is embedded in a fiber matrix are usual for the pressing part in which the previously formed paper web is mechanically dehydrated. The support in particular serves to accommodate the tractive forces acting upon the press felt and is primarily constructed as a fabric whereby the support can be constructed of several support tracks not connected with one another. A fiber fleece is then unilaterally or bilaterally sewn onto this support which provides a protection of the support from wear and tear and provides for even surfaces.

Instead of a fabric, thread layers consisting of yarns extending in one direction parallel to each other and therefore non-woven in single and multiple layer construction can also be provided. Such representative press felts can, for example, be gathered from EP-B-0 394 293 and EP-A-0 038 276. The thread layers are distinguished in that they consist of a large number of lap threads running parallel to one another, whereby the lap threads can extend longitudinally as well as transversely. These distances should be as equal as possible and remain constant over the extension of the lap threads so that the dehydration properties of the press felt are even over its surface. Nonetheless, it creates problems in manufacturing such press felts to ensure such equal and constant distances especially during the needle stitching process for the purpose of connecting and fastening the fiber fleece layers (cf. DE-C-40 40 861).

In order that the press felt is sufficiently permeable to liquids, thus guaranteeing an effective dehydration of the paper web, the lap threads must have distances from one another. These distances should be identical as far as possible and remain constant over the extension of the lap threads so that the dehydration properties of the press felt are even over its surface. Nonetheless, it creates problems in manufacturing such press felts to ensure such even and constant distances, especially in the needle stitching process for the purpose of joining and fastening the fiber fleeces.

The invention is based on the objective of developing a paper machine clothing of the type mentioned at the beginning such that the most even dehydration possible is attained over its surfaces. A further objective consists in furnishing a method for manufacturing such a paper machine clothing.

The first-mentioned objective is accomplished in accordance with the invention in that spacing threads are present which run between two lap threads and are soluble in a solvent in which the remaining part of the paper machine clothing is not soluble. The basic concept of the invention is thus to provide spacing threads between the lap threads (and indeed preferably between all lap threads) which keep the lap threads at a predetermined distance which remains constant over their extension. In this way they stabilize the position of the lap fibers and ensure their even distribution over the surface. Since they are introduced with the manufacture of the support, displacements of the lap fibers do not occur during subsequent manufacturing steps, especially during embedding the support into a fiber matrix, for example by needle stitching of fiber fleeces. That is, their distribution is maintained until finishing the paper machine clothing. Only then are the spacing fibers dissolved out in order to obtain the desired water permeability.

The dissolution out can take place before insertion into the paper machine through a corresponding washing step or, however, first after insertion whereby the dissolution takes place through the liquid pressed out of the paper web during an intake phase. In both cases, it is appropriate for the spacing fibers to be water soluble, whereby in particular threads of polyvinyl alcohol offer themselves. In the end, in this way a paper machine clothing is obtained with a support having at least one fiber lap which is distinguished by very even dehydration properties over the surface.

To be sure, incorporating soluble fibers or threads into paper machine clothes and dissolving them out before insertion into the paper machine or in an intake phase has been known in the state of the art for a long time. This nonetheless took place in order to make the paper machine clothing water-permeable in general or to enlarge its internal hollow spaces to such an extent that this could not be reached through normal manufacturing processes, and in this way to enlarge the dehydration output (cf. U.S. Pat. No. 4,482,601, EP-B-0 466 990, EP-A-0 567 206, EP-B-0 413 869; WO 98/07925; EP-A-0 123 431; DE-A-24 37 303; DE-U-70 31 398). Moreover, such fibers were also used which are not soluble when inserted into the paper machine and which were first removable through a separate washing scouring solution. The reason for this measure was to restore the original water permeability reduced by contamination again. In both cases, the goal is not comparable with that which is the basis of the present invention.

In a first development of the basic conception of the invention, the spacing threads run parallel to the lap threads. That is the lap threads and the spacing threads lie side by side, whereby it is apparent that they have a constant cross section over their extension. Moreover, as a rule, one spacing thread between two lap threads suffices so that one lap fiber always alternates with one spacing thread. As an alternative, it can be provided that the spacing threads are in each case wrapped around a lap fiber or entwined with this such that they project externally. In this way, the threads come to lie point by point upon one another, and indeed the spacing threads when all lap threads are wrapped or are entwined with spacing fibers, or by one spacing thread and one lap thread in any given case when only every second lap thread is wrapped by a spacing thread or is entwined with it. This point by point contact can be transformed into a line contact if the lap threads are wrapped completely by the spacing fibers and are constructed, for example, as surface threads or bands.

According to a further feature of the invention, it is provided that the lap threads are wrapped or entwined with a spun fiber yarn such as provided, for example, in the paper machine clothing according to EP-B-0 394 293.

According to the invention, it is furthermore proposed that lap threads be provided with outwardly projecting fibers whereby the fibers should preferably stand predominantly perpendicular to the surface of the lap threads-but also at an angle of up to 60° from perpendicular. Such lap threads can at least partially, but preferably completely replace lap threads wrapped with spun fiber yarns as they are known from EP-B-0 394 293, whereby not all lap fibers need be constructed in this way, but it is more appropriate. The advantage of such lap threads lies in the fact that such lap threads can be basically more simply and consequently more economically manufactured, for example by gluing on the fibers or here in particular by electrostatic covering with fibers or by construction as chenille threads. This opens the possibility which did not previously exist-with threads wrapped with spun fiber yarn of using monofils of various diameters, preferably in the range between 0.3 and 0.6 mm, and of giving them the identical property which was brought about by winding the lap threads with spun fiber yarn. Moreover the projecting fibers can be created not only by electrostatic covering, but also by roughening, in particular scraping the material of the monofil.

The use of monofils permits manufacturing the stitch felt on the lap basis because the monofils are suited for forming loops on the end corners of the paper machine clothing and through which these ends can be connected using a wire inserted through the loops. Such seam felts are especially basically easier to insert in the pressing part of a paper machine than press felts manufactured endlessly.

Of course, there also exists the possibility of constructing the lap threads with outwardly projecting fibers as twines of individual threads, preferably individual threads of two to twelve monofils with a diameter from 0.1 to 0.4 mm in each case, or as multifilaments. Even these threads can be electrostatically applied. Instead of this, there exists the possibility of clamping the outwardly projecting fibers between the individual fibers.

In order to improve the dehydration properties even further, it is provided in accordance with the invention that a part or all lap threads are constructed as contoured monofils. They thus have an off round cross section in which the profile runs screw-like or spiral-like viewed in the longitudinal direction of the monofil. The respective monofil is thus rotated about its long axis with respect to its outer configuration.

By using the screw-like contoured lap threads of the invention, the open volume inside the paper machine clothing is increased and better dehydration properties result. The effect can be varied by the number, construction and arrangement of these lap threads to a considerable extent and therewith adapted to the standards in question. Moreover, it does not depend upon whether the lap threads stand under torsion or tension inside the paper machine clothing. They are thus twisted only after their manufacture and have been inserted into the paper machine clothing in this condition, or if the screw-like contouring was already impressed during manufacture, for example during extrusion through appropriate nozzle shapes or during subsequent stretching. For this reason, the monofils lie without tension in the paper machine clothing.

Using flat threads rectangular in cross section or other cross section shapes of threads as well for the supports of paper machine clothes which are in part strongly contoured for specified purposes is indeed known. (Cf. DE-A-40 31 608; U.S. Pat. No. 5,361,808; DE-A-195 45 386; U.S. Pat. No. 5,591,525; EP-A-1 067 239, DE-A-199 00 989.) The contouring of these threads moreover takes place for the most varied of reasons. Nonetheless, common to all threads is that the contour is longitudinally stretched, thus extended in the axis of the respective thread and is consequently not twisted.

Great freedom exists with respect to the construction of the cross sections of the screw-like contoured monofils. They thus can have an oval, trilobate, polygonal, square, rectangular, clover-leaf and/or triangular cross section, whereby the cross sections need not even be regular or symmetrical. Moreover, monofils of different cross section can also be present in order correspondingly to exert an influence on the pore volumes and therewith assume the dehydration properties in accordance with the standards. An especially high pore volume results when screw-like contoured monofils are present in the cross section of which has several down warpings over its periphery. In contrast, however, up warpings distributed over the periphery can also be provided, or both can be combined with each other such that down and up warpings are alternatly distributed over the periphery. Moreover, sharp or rounded off corners running screw-like can also be provided.

It has proven to be beneficial if the contour of the screw-like contoured monofils has two to forty threads over 10 cm, thus that the cross section of the monofils is twisted two to forty times in this length. But the volume of the pores and therewith the dehydration properties can also be influenced through the number of threads. Here monofils with a different number of threads can also be provided.

Influence on the pore volume and therewith the dehydration capacity can also be exerted through the number of screw-like contoured monofils. Appropriately at least 30% of the lap threads extending longitudinally and/or transversely should be screw-like contoured monofils, whereby also all longitudinally and/or transverse threads can be such monofils.

Basically, there also exists the possibility of processing the screw-like profiled monofils into twines, for example such that several screw-like contoured monofils are entwined with one another. But there also exists the possibility of entwining one or more screw-like monofils with monofils shaped in another manner, for example stretched contoured monofils or round monofils and/or multifilaments.

There exist no restrictions with respect to the layer characteristic of the support. That is, the support can be constructed with one layer or many layers or can also consist of several support tracks not connected with one another through threads, which are identically constructed or are also different. Moreover, the support can also have a woven fabric, knitted fabric and/or a network as long as a layer of thread lap is present.

It is advantageous for use in a press felt if the support is embedded into a fiber matrix in which it is, for example, enclosed between at least two fiber layers which are needle stitched with each other. As regards the material of the lap threads, materials typical for paper machine clothes can be used. These are in particular thermoplastic polymers, for example polypropylene, polyamide 4.6, polyamide 6, polyamide 6.6, polyamide 6.10, polyamide 6.12, polyamide 12, PET, PTT, PPS, PEK or PEEK. Even elastomer polyesters are usable.

The invention is illustrated in greater detail on the basis of embodiments in the drawing, wherein:

FIG. 1 Provides a cross section through a press felt with thread layers as supports;

Figure 5:
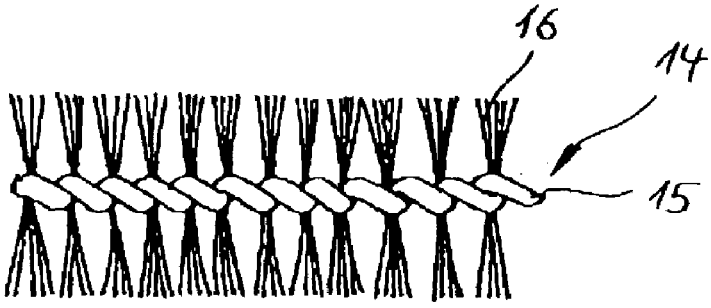
Figure 6:
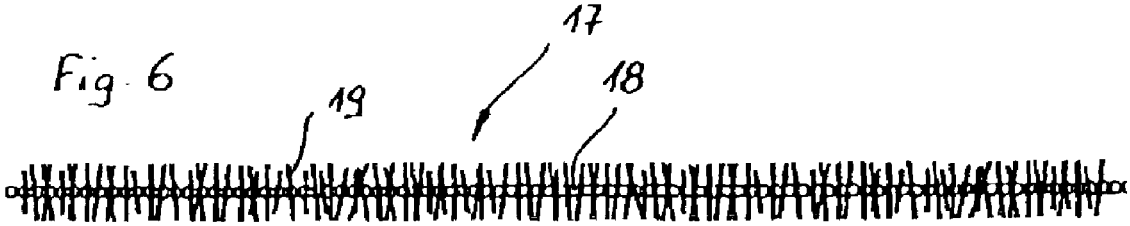
Figure 7:
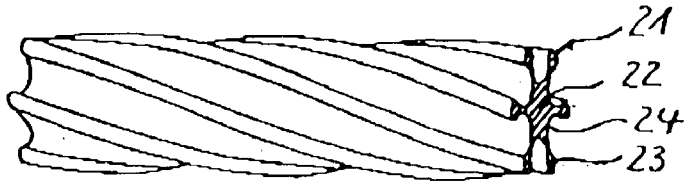
Figure 8:
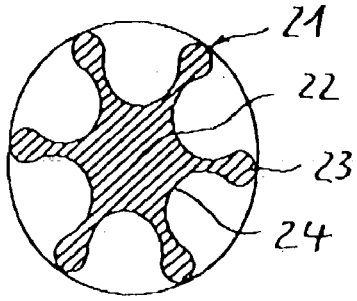
Figure 9:
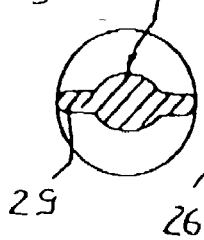
Figure 10:
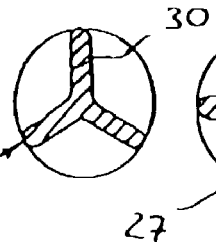
Figure 11:
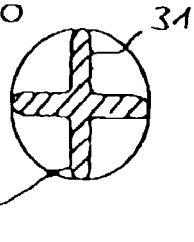
Figure 12:
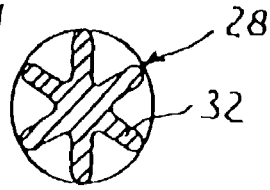

FIG. 5 Gives a view of a lap thread constructed as twine with clamped fibers;

FIG. 6 Illustrates a lap thread constructed as chenille thread;

FIG. 7 Shows a component of a lap thread constructed as a screw-like contoured monofil;

FIG. 8 Depicts a cross section through the lap thread in accordance with FIG. 7;

FIGS. 9 through 17 Reveals different cross sections of lap threads which are constructed as screw-like contoured monofils.

Figure 1:
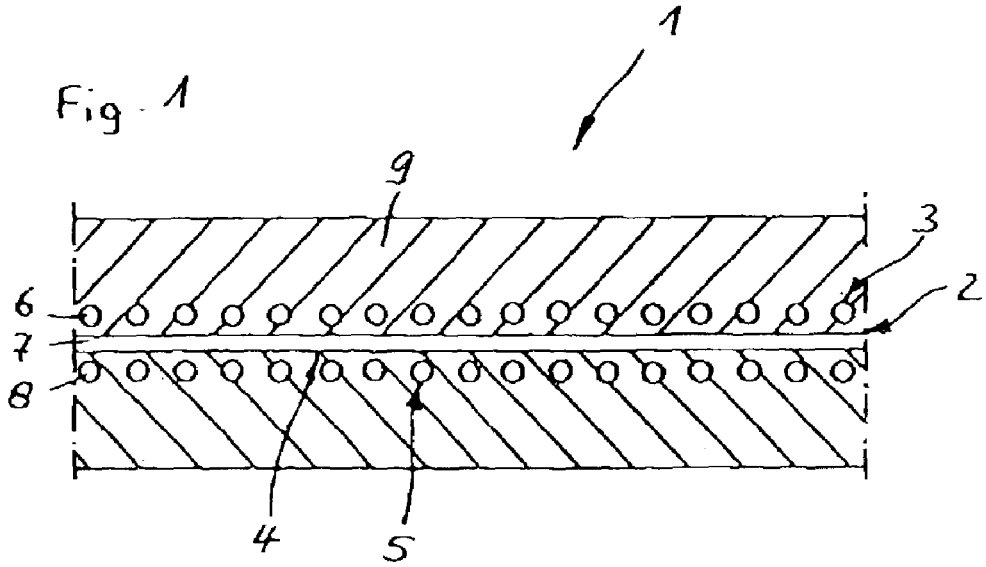
Figure 2:
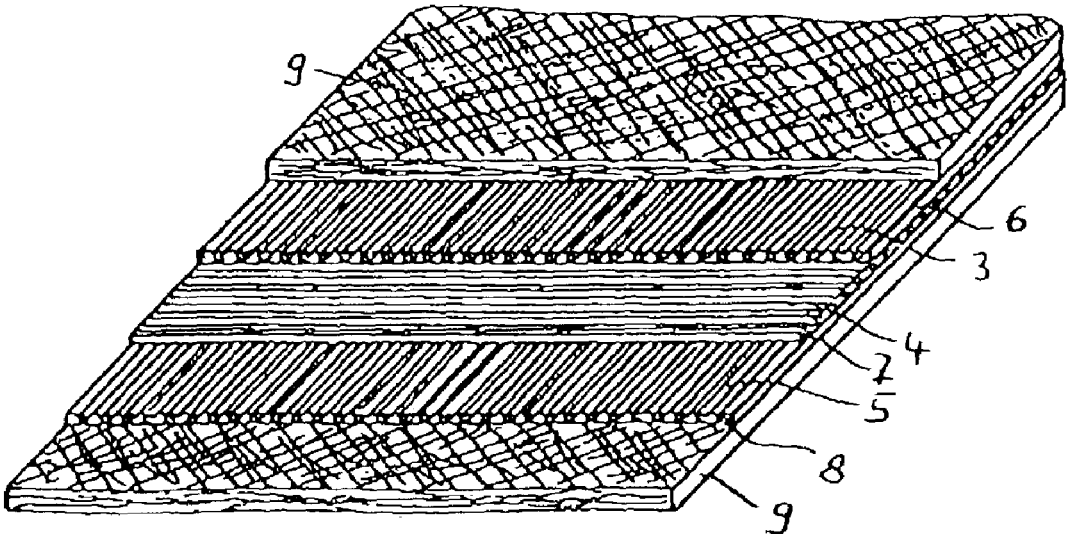
FIG. 2 Illustrates a partial section of the press felt in accordance with FIG. 1 in three quarters view, whereby the in each case upper layer is shortened in relation to the in each case lower layer.

The press felt 1 shown in FIGS. 1 and 2 has a support 2 which consists of three layers laid one over the other which are constructed in each case as thread layers 3, 4, 5, consisting of yarns extending in one direction parallel to each other and therefore non-woven. All three thread layers 3, 4, 5 in each consist of lap threads running parallel on the plane of the press felt 1 (designated by way of example with 6, 7, 8) which in each case have the same distance from one another. The lap threads 6, 8 of upper and lower thread layers moreover run in the longitudinal direction of the press felt 1 which at the same time is its direction of travel, while the lap threads 7 of the central thread lap 4 extend transversely in relation thereto. The support 2 is embedded in the middle of a fiber matrix 9 which is represented merely by layer in FIG. 2 and arose by needle stitching of fiber fleeces.

The press felt 1 can already be seen in its final state. The distances between the lap threads 6, 7, 8 are characteristic. These distances were brought about in that spacing threads were worked in between the lap threads 6, 7, 8 already during manufacture of the support 2 the extension of which in the plane of the respective thread lap 3, 4, 5 corresponded to the now free distance between lap threads 6, 7, 8 to be recognized in FIGS. 1 and 2. Moreover, the spacing threads can have had a square or rectangular cross section in order to avoid a sliding one over the other of spacing threads and lap threads 6, 7, 8.

The support 2 is then covered with fiber fleeces and run through a needle machine in which the fiber fleeces are interlocked with and fastened to one another while forming a fiber matrix 9. Moreover the spacing threads have-ensured that displacements of the lap threads 6, 7, 8 have not occurred. Subsequently the spacing threads have been dissolved under the action of a solvent (water can be used as a solvent with spacing threads of polyvinyl alcohol), on account of which the free spaces between lap threads 6, 7, 8 resulted.

Figure 3:
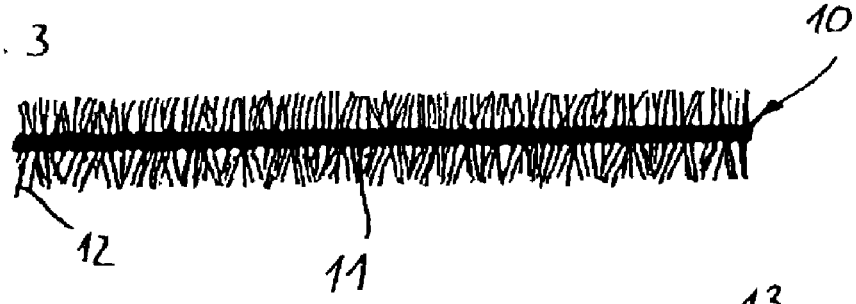
FIG. 3 Shows an electrostatically applied lap thread.

FIG. 3 depicts in side view a lap thread 10, which has a monofil 11 which is electrostatically covered with fibers basically projecting vertically from its surface, designated by way of example with 12.

Figure 4:
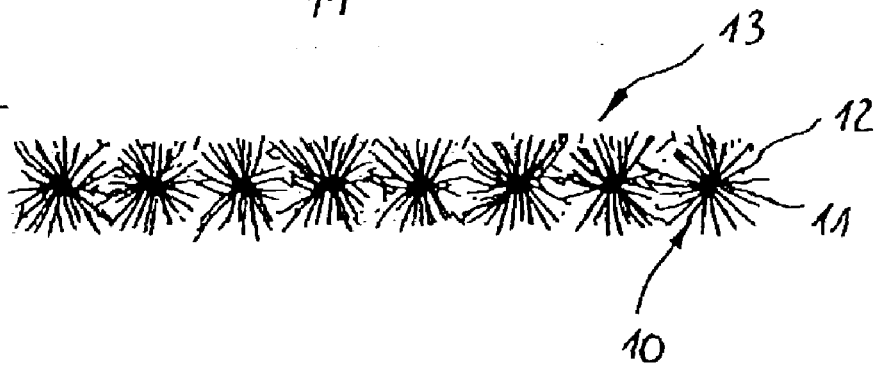
FIG. 4 Depicts a cross section through a thread lap with electrostatically applied lap threads.

FIG. 4 depicts a thread lap 13 with lap threads 10 in accordance with FIG. 3, whereby the thread lap 13 consists of a large number of lap threads 10 arranged alongside one another running parallel to one another, which have the same distances from one another.

FIG. 5 shows a lap thread 14, which consists of a twine 15 with clamped fiber sheaves projecting vertically between the individual threads of the twine 15, designated with 16 by way of example. It is obvious that these fiber sheaves 16 are distributed over the periphery, to be seen similar to the case of the thread lap 13.

FIG. 6 depicts a lap thread 17, which is constructed as a chenille thread with a core thread 18 and fibers basically projecting vertically from it, designated by way of example with 19.

A lap thread 21 is represented in FIGS. 7 and 8, which is constructed as a monofil and is constructed with a rotation symmetrical cross section with a core 22 and a total of six radially outwardly projecting bars, designated by way of example with 23. The bars 23 are enclosed between deep downward warpings-designated by way of example with 24-which form grooves over the length with the lap thread 21.

As is apparent from FIG. 7, the contour of the lap thread 21 is configured screw-like, thus inwardly twisted on the basis of its outer configuration, so that the bars 23 and also the grooves formed by the downward warpings 24 run screw-like about the core 22 of the lap thread 21. If such lap threads 21 are incorporated into the support of paper machine clothing, there arises a pore volume owing to this whereby the grooves formed by the downward warpings 24 form dehydration channels.

Other embodiments of lap threads 25, 26, 27, 28 are represented in FIGS. 9 to 12. They are likewise rotation-symmetrical and have a different number of radially running bars, designated as 29, 30, 31, 32 by way of example.

Figure 13:
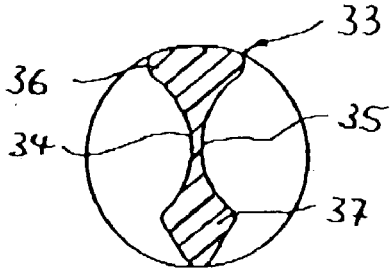

A lap thread 33 is disclosed in FIG. 13, which is only mirror-symmetrical. It has two opposed downward warpings 34, 35 which run bilaterally into thickenings 36, 37 of different shape.

Figure 14:
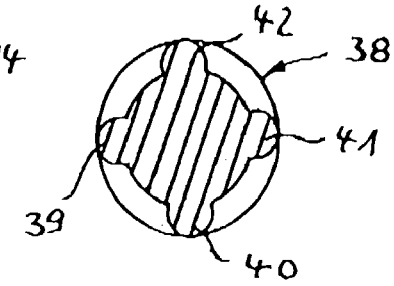

A screw-like configured lap thread 38 is represented in FIG. 14 which is constructed rotation-symmetrical and has four upward warpings 39, 40, 41, 42 distributed over the periphery, whereby the upward warpings 39, 40, 41, 42 are connected through convex regions. Groove-like depressions also result with this contour.

Figure 15:
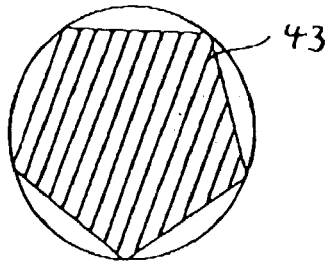
Figure 16:
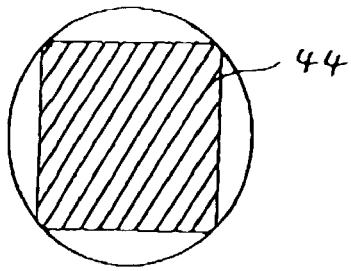
Figure 17:
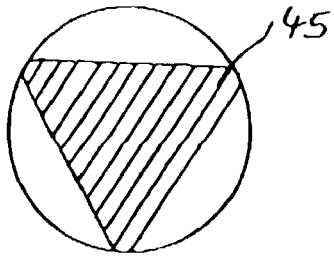

Further screw-like contoured lap threads 43, 44, 45 are represented in cross section in FIGS. 15 to 17, and indeed with a regular pentagon (FIG. 15), a square (FIG. 16) and a triangle (FIG. 17). Even if the connection of the corners or edges of these lap threads 43, 44, 45 form trenches, pore volumes and dehydration channels arise through the screw-like contour.

I claim:

1. Method for manufacturing a paper machine clothing (1) comprising the steps of:

providing a support (2) which has at least one nonwoven thread lap (3, 4, 5, 13) with lap threads (6, 7, 8, 10, 14, 17, 21, 25, 26, 27, 28, 33, 38, 43, 44, 45) running parallel to one another, the lap threads formed from a material selected from the group consisting of polypropylene, polyamide 4,6, polyamide 6, polyamide 6.6, polyamide 6.10, polyamide 6.12, polyamide 11, polyamide 12, PET, PTT, PBT, PPS, PEK, PEEK and an elastomer polyester;

incorporating spacing threads between two adjacent lap threads of said at least one thread lap during manufacture of the thread lap (3, 4, 5, 13) which are soluble in a solvent in which the remaining part of the paper machine clothing (1) is not soluble;

removing the spacing threads from the thread lap (3, 4, 5, 13) using the solvent.

2. Method according to claim 1, characterized in that the support (2) is at first embedded into a fiber matrix (9) and only then are the spacing fibers removed.

3. Method according to claim 1, characterized in that water soluble threads are used as spacing threads and in that dissolution of the spacing threads takes place using an aqueous liquid.

4. A method of manufacturing a paper machine clothing, comprising the steps of:

providing a plurality of lap threads formed from a material selected from the group consisting of polypropylene, polyamide 4,6, polyamide 6, polyamide 6.6, polyamide 6.10, polyamide 6.12, polyamide 11, polyamide 12, PET, PTT, PBT, PPS, PEK, PEEK and an elastomer polyester, the lap threads extending parallel to one another and forming a nonwoven thread layer of a support, the lap threads being non-soluble in a solution;

disposing at least one spacing thread between adjacent lap threads of said thread layer and extending parallel to the adjacent lap threads of said thread layer, the spacing thread being soluble in the solution;

exposing the thread layer to the solution and thereby dissolving the spacing thread so that the lap threads are spaced from each other by a distance corresponding to a width of the spacing thread.

5. The method of claim 4, comprising the further step of embedding the support into a fiber matrix prior to said exposing step.

6. The method of claim 4, wherein the spacing thread is water soluble.

7. the method of claim 6, wherein the solution is aqueous.

8. The method of claim 4, including the step of wrapping the spacing thread around one of the lap threads.

9. The method of claim 4, including the step of entwining at least one of the lap threads with spun fiber yam.

10. The method of claim 4, wherein each of the lap threads includes outwardly projecting fibers.

11. The method of claim 10, wherein the fibers extend outwardly from a major surface of the corresponding lap thread at an angle of between 0° to about 60° from perpendicular to the major surface.

12. The method of claim 10, including the step of adhesively securing the fibers to a major surface of the corresponding lap thread.

13. The method of claim 12, including the step of electrostatically depositing the fibers onto the major surface prior to said securing step.

14. The method of claim 4, wherein the lap threads are chenille threads including outwardly projecting fibers.

15. The method of claim 10, wherein the fibers have a length of between about 0.5 mm and about 1.6 mm.

16. The method of claim 10, wherein the lap threads fibers are monofils with outwardly projecting fibers.

17. The method of claim 16, wherein the monofils have a diameter of between about 0.3 mm and about 0.6 mm.

18. The method of claim 16, including the step of roughening a surface of the monfils to form the outwardly projecting fibers.

19. The method of claim 10, wherein the lap threads are twines of two or more threads with outwardly projecting fibers.

20. The method of claim 19, wherein each of the twines has a diameter of between about 0.1 mm and about 0.4 mm.

21. The method of claim 19, wherein the twines are constructed as multifilaments.

22. The method of claim 19, wherein a portion of the outwardly projecting fibers are clamped between threads in the twine.

23. The method of claim 4, wherein the lap threads are contoured monofils having a core with outwardly extending bars extending radially therefrom.

24. The method of claim 23, wherein the monofils have one of an oval trilobate, polygonal, square, rectangular, cloverleaf and triangular configuration in cross-section.

25. The method of claim 23, wherein the cross-sectional configuration of the monofils includes downward warpings distributed over a periphery.

26. The method of claim 23, wherein the cross-sectional configuration of the monofils includes upward warpings distributed over a periphery.

27. The method of claim 25, wherein the cross-sectional configuration of the monofils also includes upward warpings distributed over the periphery and interposed between the downward warpings.

28. The method of claim 23, wherein the bars include sharp edges longitudinally spiraling about the core.

29. The method of claim 23, wherein the bars include rounded edges longitudinally spiraling about the core.

30. The method of claim 23, wherein the thread layer includes between two and four lap threads having a length greater than about 10 cm.

31. The method of claim 4, wherein at least about 30% of the lap threads of the support are contoured monfils having a core with outwardly extending bars extending radially therefrom.

32. The method of claim 19, wherein at least one of the twined lap threads is a contoured monofils having a core with outwardly extending bars extending radially therefrom.

33. The method of claim 4, wherein the support includes a plurality of thread layers.

34. The method of claim 4, wherein the support includes one of a knitted fabric, a woven fabric and a network.

35. The method of claim 4, including the further step of enclosing the support between at least two fiber layers.

* * * * *